United States Patent [19]

Sterwerf, Jr.

[11] Patent Number: 4,674,803

[45] Date of Patent: Jun. 23, 1987

[54] ENDLESS CHAINS COMPRISED OF INTERDIGITATED LINK ELEMENTS HAVING AN H-SHAPED CONFIGURATION

[75] Inventor: Lester J. Sterwerf, Jr., Harrison, Ohio

[73] Assignee: The Cincinnati Mine Machinery Company, Cincinnati, Ohio

[21] Appl. No.: 729,571

[22] Filed: May 2, 1985

[51] Int. Cl.[4] ..... E21C 27/26; E21C 25/34

[52] U.S. Cl. ..... 299/82; 474/223

[58] Field of Search ..... 299/82-84; 474/206, 219, 223, 226; 59/4, 5, 7, 8

[56] References Cited

U.S. PATENT DOCUMENTS

| | | | |
|---|---|---|---|
| 2,391,485 | 12/1945 | Simmons | 299/82 |
| 3,086,404 | 4/1963 | Krekeler | 474/223 |
| 3,463,026 | 8/1969 | Staub et al. | 299/82 |
| 3,679,265 | 7/1972 | Krekeler | 299/84 |
| 3,888,133 | 6/1975 | Krekeler | 299/82 X |

FOREIGN PATENT DOCUMENTS

| | | | |
|---|---|---|---|
| 1166720 | 4/1964 | Fed. Rep. of Germany | 299/82 |
| 868605 | 5/1961 | United Kingdom | 299/82 |
| 1054399 | 1/1967 | United Kingdom | 299/82 |

*Primary Examiner*—Stephen J. Novosad
*Assistant Examiner*—Michael A. Goodwin
*Attorney, Agent, or Firm*—Frost & Jacobs

[57] ABSTRACT

An endless chain in which there is one row of a plurality of H-shaped link elements across the width of the chain and an adjacent row of similar elements, the legs of the Hs of adjacent rows being interdigitated and provided with aligned openings which receive a connecting pin. This arrangement is continued along the length of the chain to whatever extent is desired. Bit carrying lugs are mounted on the H-shaped link elements so as to establish any bit pattern desired. The H-shaped link elements may be provided with bit carrying lugs that are skewed with respect to the direction of chain travel so as to make the chain more efficient. Such link elements may also be provided with load bearing lugs at their sides so as to give increased support for the chain. The arrangement of link elements is such that, in order to shorten the length of the chain to accommodate for slack occasioned by wear, a pair of adjacent rows of H-shaped link elements may be removed and replaced by either appropriately off-set H-shaped link elements and spacers, H-shaped link elements make possible the provision of an unusually sturdy chain requiring only a minimum number of major chain parts so that the mine owner or operator need stock only a relatively small number of parts, both as to type and as to overall quantity.

71 Claims, 25 Drawing Figures

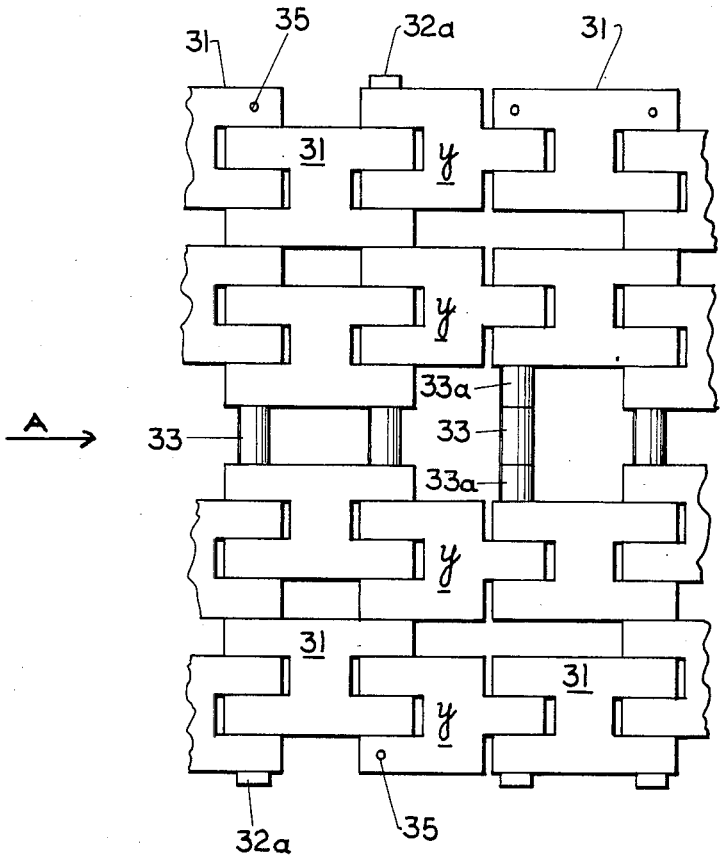
FIG. 11
FIG. 16
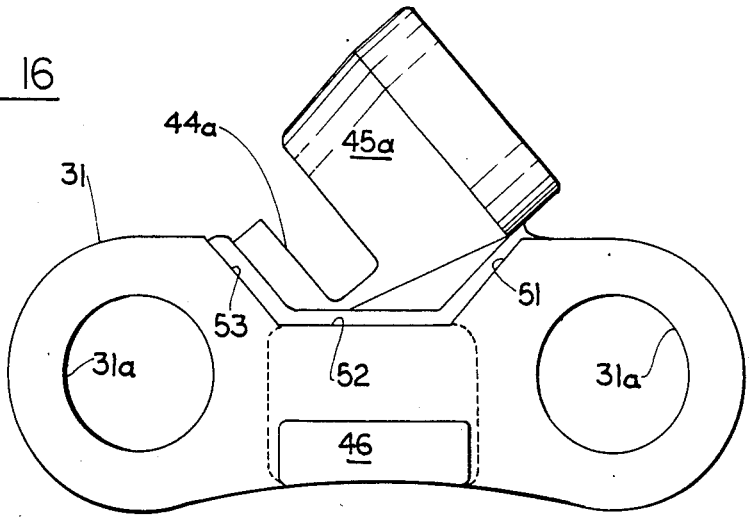

ENDLESS CHAINS COMPRISED OF INTERDIGITATED LINK ELEMENTS HAVING AN H-SHAPED CONFIGURATION

TECHNICAL FIELD

The invention relates to a novel chain construction by which the chain may be varied both in length and in width and which may be adapted to carry cutting tools in any desired pattern or arrangement, but which requires only a relatively small number of standardized parts for its construction. While the chain of the present invention may have many applications, as will be described hereinafter, it is particularly useful as a trim chain for a drum-type mining machine. In more general terms, however, the invention relates to the mining and construction industries, including the mining of coal, potash, salt, gypsum and other substances, and including also earth working, trenching and road scarifying and planing equipment.

BACKGROUND ART

Drum-type mining machines have come into extensive use. Briefly, such machines generally comprise a self-propelled vehicle having a centrally located conveyor means for removing the material being mined. At the forward end of the machine, one or more movable beams support a horizontally oriented drum. The dum bears a plurality of cutting tools. Frequently, the cutting tools are oriented on the drum in a pattern comprising two oppositely oriented helices which are directed toward the center of the drum. This aids in conducting the cut material toward the center of the machine and the conveyor which forms a part of it.

Through an appropriate drive mechanism and gearing, in association with the beam or beams, the drum is caused to rotate about its axis to produce the cutting action. In the usual practice, the machine is brought to the face of the material being cut and the drum is sumped into the face at the top thereof. Thereafter, through the agency of the beam or beams, the rotating drum is caused to move downwardly, making a complete vertical cut at the face of the material. This procedure is then repeated and the mine entry is thereby advanced.

At the position or positions where the drum is supported on one or more of the beams, the drum cannot carry cutting tools. Therefore, one or more trim chains are required to fill in those portions of the drum not otherwise provided with cutting tools. By virtue of the construction of such mining machines, it often develops that the trim chains have to be of considerable width. As a consequence, such trim chains usually carry a plurality of cutting tools located in patterns of staggered rows extending the width of the chain, so that the chain will make a full width cut.

The earlier of such trim chains were comprised of a plurality of chain blocks joined together by two or more connecting links. Each block was as wide as the chain width required and each carried at least one cutting tool in a predetermined position along the chain width. Thus, for each cutting tool position there had to be a separate type of chain block configured to mount the cutting tool in that position.

These earlier trim chains performed fairly well in the field but they required the mine owner to carry a large inventory of different and expensive wide chain blocks for purposes of replacement and repair. In addition, since some mine owners could have several different drum-type mining machines, each using trim chains of different widths, he would then be required to maintain an inventory of sets of wide chain blocks for each of machine.

Improvement on these wide block trim chains, however, has been made. Such improvement has generally taken the form of a chain construction in which the trim chain is comprised of a plurality of interdigitated link elements, some of which are simply connecting links, and some of which are bit carrying links. Spacer means may be substituted for selected ones of the connecting links or of the bit carrying links and as a consequence the term "link element" is generally construed as encompassing connecting links, bit carrying links and spacer means Improved trim chains of the type just mentioned are shown in U.S. Pat. Nos. 3,679,265 and 3,888,133. These improved trim chains are made up of a plurality of transverse rows of link elements with any desired arrangement of connecting links and bit carrying links. The number of elements in each row may be varied so as to provide a trim chain of any desired width. As indicated, the ends of the link elements of adjacent rows are interdigitated and held together by connecting pins of appropriate length passing through coaxial perforations in the interdigitated link element ends. These chains may be driven by sprocket means engaging the ends of selected link elements at selected positions along the width of the chain, or by engaging the ends of the connecting pins.

The aforementioned patents make other teachings which may also be incorporated in the chain of the instant invention. Thus, for example, it is taught that spacer elements may be substituted for a connecting link, for purposes of economy Not only may the bits be located in various patterns on the selected link elements but also the bit may be skewed; that is, selected bits may be in line with the axis of the chain and the direction of chain movement, i.e., the cutting direction, while other bits may be oblique thereto. These patents also teach means for retaining the connecting pins in the chain and for protecting them from wear. It is also taught in these patents that chains of this general type may be modified to serve as a tread for a self-propelled vehicle and it is indicated that when so used all of the link elements comprising the chain may be identical, or the chain may be comprised of a plurality of standard link elements and a plurality of modified link elements to produce various desired results. These features, and others, may be incorporated in the instant invention.

DISCLOSURE OF THE INVENTION

The present invention is directed to an endless chain comprised of interdigitated link elements in which the primary link elements have an H-shaped configuration. This results in a chain having the flexibility of the prior art chains, the ability to provide for a variety of bit patterns, and the necessity of stocking only a relatively few chain parts, while at the same time providing a more stable chain of rugged construction. Each H-shaped (when viewed in plan) link element may have one or more bit carrying lugs placed thereon in a variety of positions and this further contributes to the ability to make up chains having a wide variety of bit patterns. Thus, the invention makes it possible to achieve a rugged chain of any desired width or length, within practical ranges, while using only a relatively few types and quantities of major link elements, and at the same time making possible a wide variety of bit patterns.

BRIEF DESCRIPTION OF THE DRAWINGS

FIG. 11 is a view similar to that of FIG. 10 but having the off-set H-shaped link elements replaced by Y-shaped link elements along with the use of certain spacers.

FIG. 16 is a side elevation of one of the H-shaped link elements of this invention and illustrating a different type of bit carrying lug mounted thereon.

DETAILED DESCRIPTION OF THE INVENTION

Figure 1:
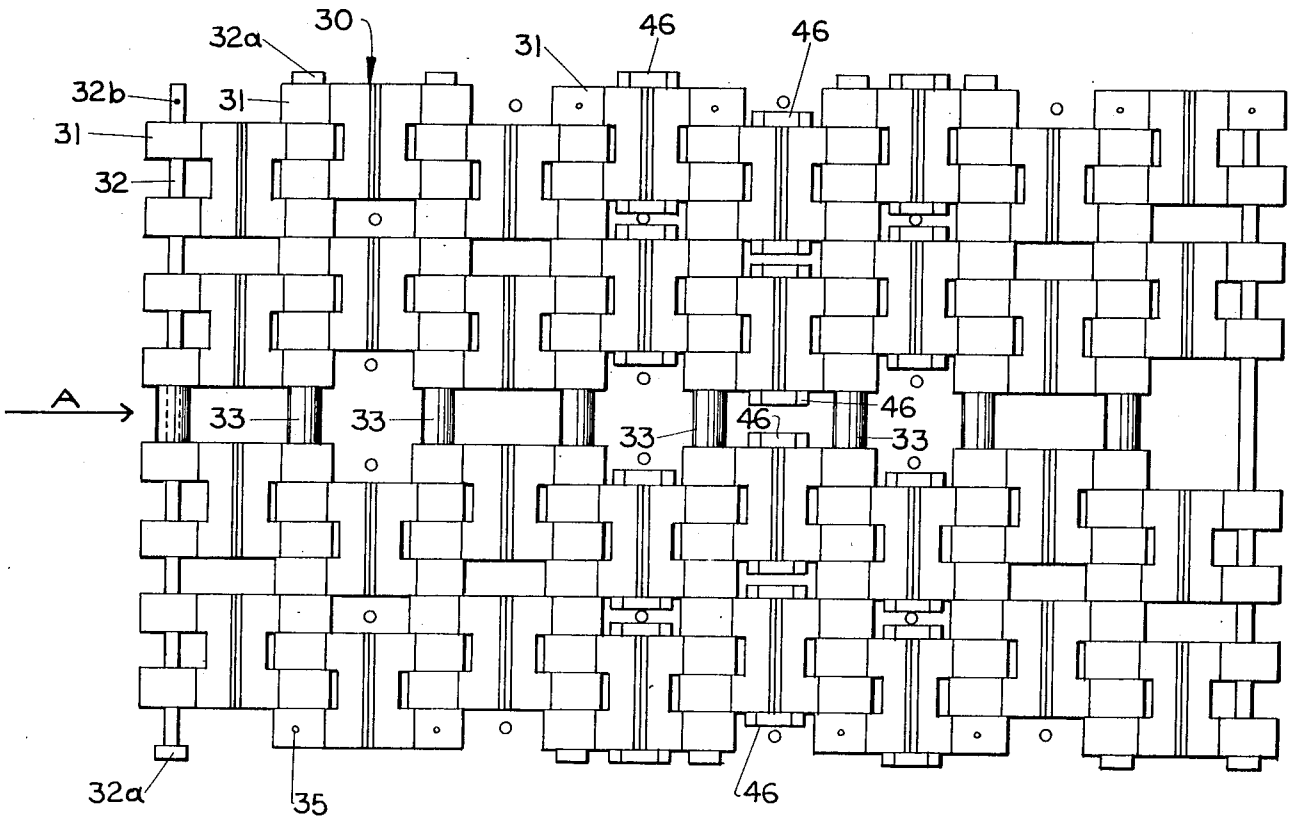
FIG. 1 is a plan view of a section of chain comprised of H-shaped link elements each having transverse perforations at its forward and rearward ends, the link elements being arranged in lateral rows across the width of the chain, the rows of link elements being located one behind the other with the ends of the link elements of adjacent rows being in intergitated relationship with their transverse perforations coaxially aligned so as to receive a connecting pin which passes therethrough, and further illustrating two different types of H-shaped link elements

Referring first to FIGS. 1, 2, 3 and 22, sections of several different types of chains, each embodying the invention, are illustrated. In FIG. 1 the section of chain 30 is depicted as comprised of a number of link elements 31, some of which will be equipped with bit carrying lugs so as to form a desired bit pattern throughout the chain as is known and understood in the art, all of the link elements, whether equipped with a bit carrying lug or not, being generally shaped like an H when viewed in plan, the link elements being interdigitated in successive rows and the legs of the various H-shaped link elements being perforated as at 31*a* (FIG. 4) so as to receive a connecting pin or pintle 32. Spacer elements 33 may be employed where necessary to lend stability to the chain and to provide for various manners of driving the chains; these elements are located on the connecting pins between adjacent H-shaped link elements. The chain 30 of FIG. 1 is designed to be supported at its sides (the top and bottom as viewed in FIG. 1) and to be driven by a sprocket located centrally thereof and having teeth to engage the centrally located spacer elements 33. The area to be engaged by the sprocket is generally indicated by the arrow A in FIG. 1. As will be amplified shortly, two different styles of H-shaped link elements are illustrated in FIG. 1.

Figure 2:
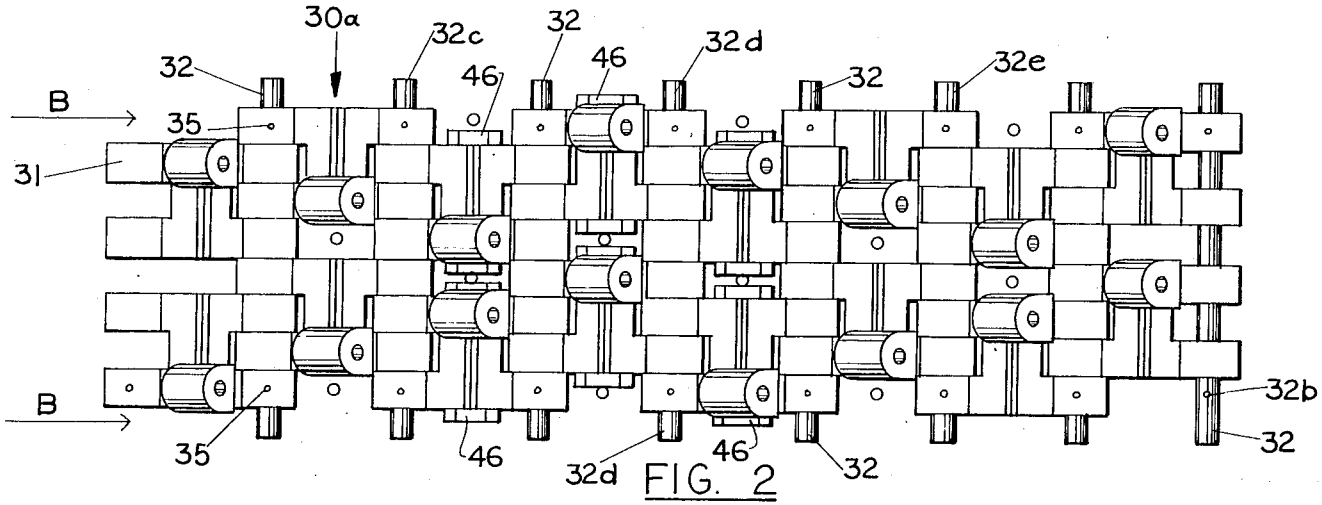
FIG. 2 is a plan view similar to FIG. 1 but illustrating a narrower chain and a different arrangement for the connecting pins.
Figure 3:
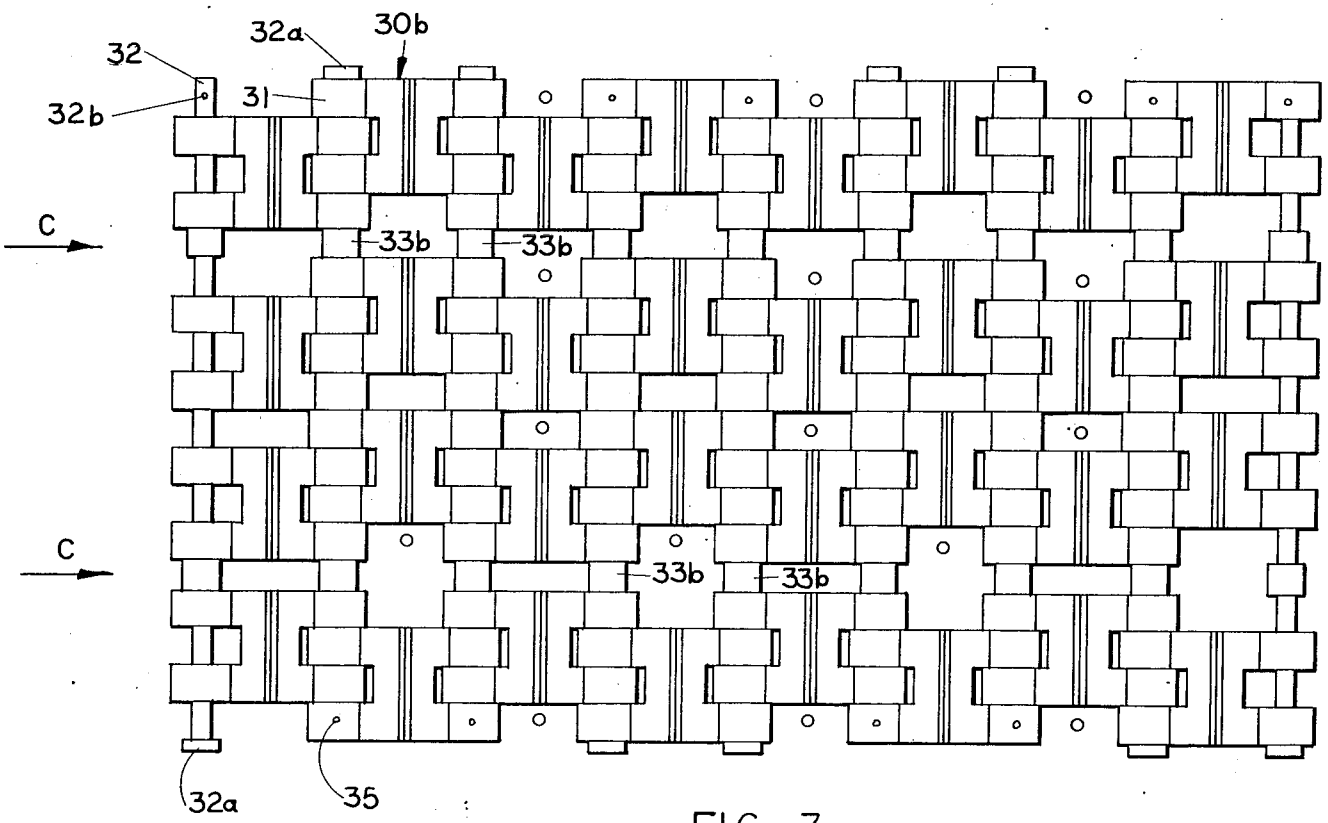
FIG. 3 is another plan view similar to FIGS. 1 and 2 but illustrating a different arrangement of H-shaped elements and spacers so as to achieve a different manner of driving the chain.

The chains of FIGS. 1 and 3 are comprised of H-shaped link elements which are arranged four to a row across the chain if one considers a row as made up of those H-shaped link elements which are disposed between adjacent pintles or connecting pins 32. (If one considers a row to include the number of H-shaped link elements engaged by any one connecting pin 32, then there are eight per row in the arrangement of FIGS. 1 and 3.) In FIG. 2 the chain is depicted as comprised of two H-shaped link elements per row (*between* pintles) or four if one considers the number of H-shaped link elements *on* any one of said pintles. Hereinafter a row of H-shaped link elements will refer to those link elements disposed *between* adjacent connecting pins in lateral spaced alignment across the width of a chain.

The chain 30*a* of FIG. 2 is depicted as being half as wide (from top to bottom as viewed in that FIG.) as the chain 30 of FIG. 1. This chain 30*a* is adapted to be driven by sprockets which engage the protruding ends of the connecting pins 32, the sprocket arrangement being such that a tooth may engage every other connecting pin 32 as indicated at 32*c*, 32*d* and 32*e* by way of example only. It would be possible to arrange the sprocket teeth to engage all of the pins 32 although it might be necessary to omit those lugs 46 which would otherwise be disposed between the ends of adjacent pins 32. The arrows B further indicate the drive for the chain 30*a* of FIG. 2. As will be discussed in further detail shortly, the chain of FIG. 2 is also illustrated as comprised of two different types of H-shaped link elements. No spacer elements are required for the chain 30*a*.

The chain 30*b* of FIG. 3 is approximately the same width as the chain 30 of FIG. 1 but the H-shaped link elements, all of which are depicted as being of a given type, are arranged somewhat differently so that the chain may be driven by a pair of sprockets which engage spacer elements 33*b* located on connecting pins 32 in the areas indicated by the pair of arrows marked by the letter C. The spacer elements 33*b* are mounted on the connecting pins 32 between adjacent H-shaped link elements.

It has heretofore been mentioned that the H-shaped link elements of the present invention may be arranged so as to achieve a variety of chains. Some of these are depicted in FIGS. 1, 2, 3 and 22. It has also been mentioned that some of the chains illustrate two different styles of H-shaped link elements and that the link elements 31, connecting pins 32 and spacers 33 may be arranged so as to permit the chain to be driven at a variety of locations. These have so far been indicated as on the spacers 33 located centrally of the chain (FIG. 1), the ends of the connecting pins 32 (FIG. 2), and the spacers 33*b* located inwardly from either side of the chain (FIG. 3). Many times, however, the chain is driven by sprocket teeth which engage the ends of the link elements themselves. In each of FIGS. 1, 2, 3 and 22 these areas of link element-sprocket tooth engagement have been indicated by the letter O. It may be that in those instances where the link element, sprocket tooth area is also occupied by a load carrying lug 46, such load carrying lug may have to be machined off or otherwise removed. It will immediately become apparent that these link element-sprocket tooth engaging areas provide a great deal of versatility to the manner in which these chains may be driven.

By way of brief review, therefore, it will be observed that the chains may be driven by the sprocket teeth engaging the ends of various of the H-shaped link elements, or by engaging spacers interspersed throughout the chain, or by engaging the ends of the connecting pins. In a chain like that of FIG. 2 wherein it is desired to drive it by sprocket teeth engaging the outermost link element-sprocket tooth areas O it will be necessary to off-set the sprockets to accommodate for the fact that the areas O at the outermost sides of the chain are not directly opposite one another. In such a chain as depicted in FIG. 2 it may also be desirable to cut off a portion of the ends of the connecting pins 32. In those instances, however, wherein chain drive is accomplished by the teeth engaging the ends of such connecting pins they will be left in tact as shown in FIG. 2.

It has been mentioned that FIGS. 1 and 2 illustrate two styles of H-shaped link elements 31. The preferred style of link element is that shown in FIG. 16. In this style of H-shaped link element 31 the center portion of the element, in the region of the bridge, is defined by a pair of sloping surfaces 51 and 53 each of which terminates at the horizontal surface 52. This element also incorporates the load bearing lugs 46. It is on these surfaces 51–53 that the bit carrying lugs 45*a* will be disposed, either in line with the axis of the chain and the direction of chain movement (cutting direction), or skewed with respect thereto as will be discussed more fully hereinafter.

In all of the chains of FIGS. 1, 2, 3 and 22 it will be understood that additional H-shaped link elements and connecting pins may be added to either end (the right and left as viewed in the FIGS.) of the chain so as to achieve a chain of any desired length as circumstances may require. Two different styles of connecting pins or pintles have been illustrated. In FIGS. 1 and 3 the connecting pin 32 is provided at one end with a head 32*a* and at the other end with a perforation 32*b* adapted to receive a pin 34 (see FIGS. 12 through 15 which will be described in detail shortly) driven through a corresponding perforation 35 in the outermost leg of the H-shaped element futherest removed from the connecting pin head 32*a*. The connecting pin 32 of FIG. 2 is like that of FIGS. 1 and 3 except that the head 32*a* has been omitted. In this arrangement perforations 32*b* are provided near both ends of the connecting pin 32 and retaining pins 34 are driven through corresponding perforations 35 in the outermost leg of each H-shaped link element disposed at the outer sides of the chain. It should also be noted, however, as will be understood by those skilled in the art, that there are other ways in which the connecting pins or pintles 32 may be satisfactorily secured. Some of these, for example, are shown in U.S. Pat. Nos. 3,679,265 and 3,888,133.

Figure 4:
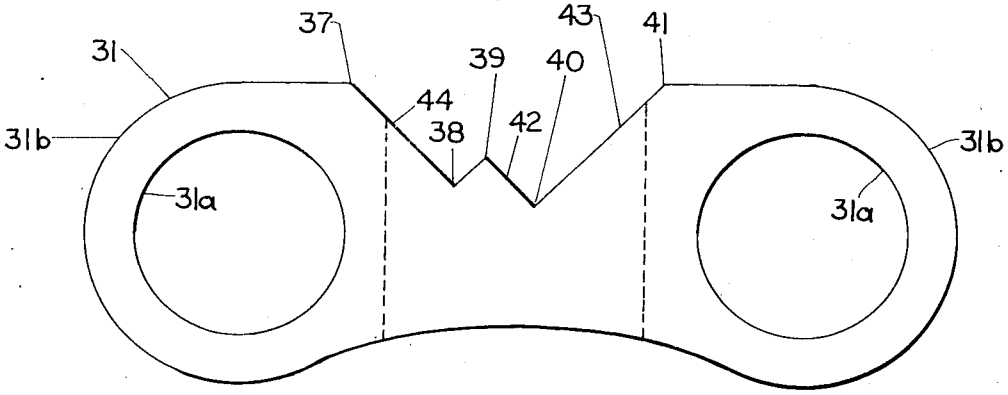
FIG. 4 is an enlarged side elevation of one of the H-shaped link elements of this invention
Figure 5:
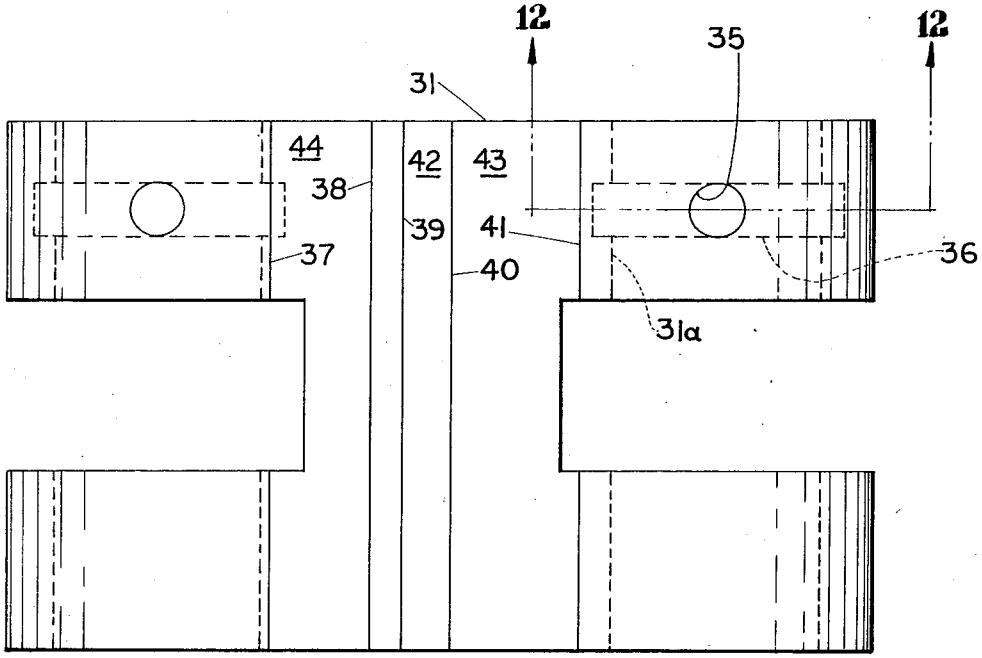
FIG. 5 is a plan view of the link element of FIG. 4.
Figure 12:
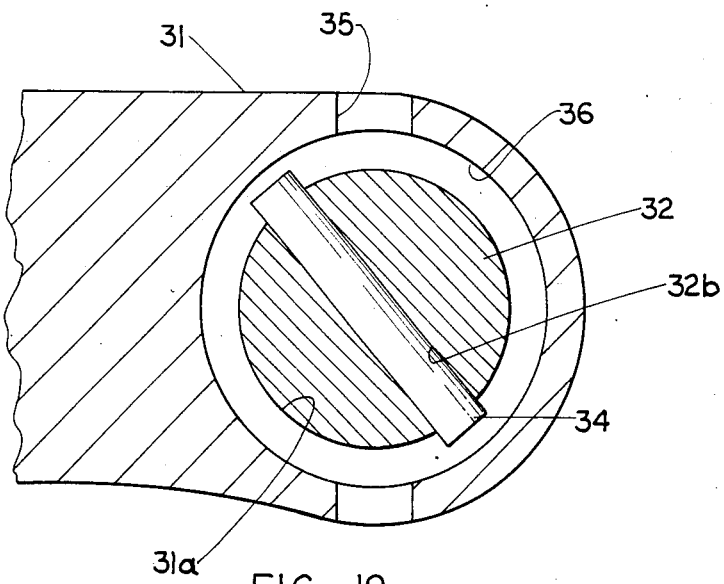
FIG. 12 s an enlarged section taken on the line 12—12 of FIG. 5.

Referring now to FIGS. 4, 5 and 12, another one of the styles of H-shaped link elements 31 will be described. FIGS. 5 and 12, along with FIGS. 13 through 15, further depict and illustrate some of the features already discussed. Thus, the relationship among the H-shaped link element 31, connecting pin 32, perforation 32*b*, retaining pin 34 and link perforation 35 is shown in detail. In addition the leg of the link element 31 which is disposed at the outermost side of the chain is provided with an annular groove 36 to receive the retaining pin 34. Such pin 34, of course, must be longer than the diameter of the connecting pin 32 and shorter than the diameter of the annular groove 36; this insures that those link elements and spacer elements which are joined by a particular connecting pin 32 will be maintained thereon between the connecting pin head 32*a* and that link 31 which is secured at the opposite end of the connecting pin 32 by the retainer pin 34 acting within the groove 36. This permits the pin 34 to rotate in the groove 36. It should be further noted that the retaining pin 34 is bent slightly, and the pin 34 manufactured of such metal or other substance, that when the pin is forced through the link perforation 35 and connecting pin perforation 32*b* it will be retained in the perforation 32*b* with an interference fit, again noting that the pin 34 is driven into the perforation 32*b* so that the ends of the pin reside in the annular groove 36 provided in the link element 31 in the region of the link element perforation 35. This same arrangement may be employed at both ends of the connecting pin 32 when chains like that of FIG. 2 are utilized.

As best seen in FIG. 4 the center portion of this style H-shaped link carrying element 31 resembles the letter W in side elevation as defined by those surfaces which are established by the lines indicated at 37, 38, 39, 40 and 41. The sloping surfaces 42 and 43 defined by the lines 39–40 and 40–41 respectively, are adapted to receive a bit carrying lug 45 (FIG. 6) which may be welded thereto. The surface 44 defined by the lines 37–38 may act as an abutment surface for a bit received in the lug and passing therethrough, in those instances wherein the bit and lug are of the type shown in U.S. Pat. No. 3,397,012. Other types of bits, however, may be employed and in general the type of bit does not constitute a limitation on the invention claimed herein.

Figure 7:
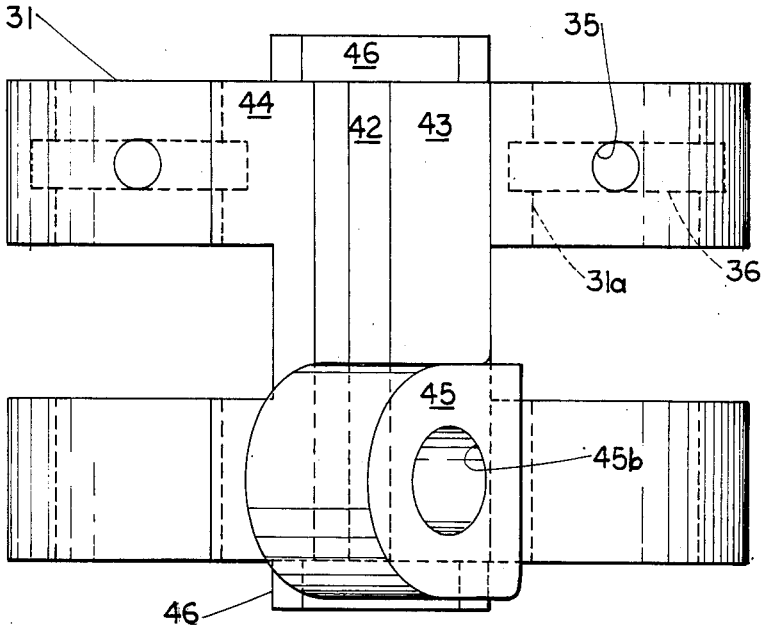
FIG. 7 is a plan view of the link element of FIG. 6.
Figure 8:
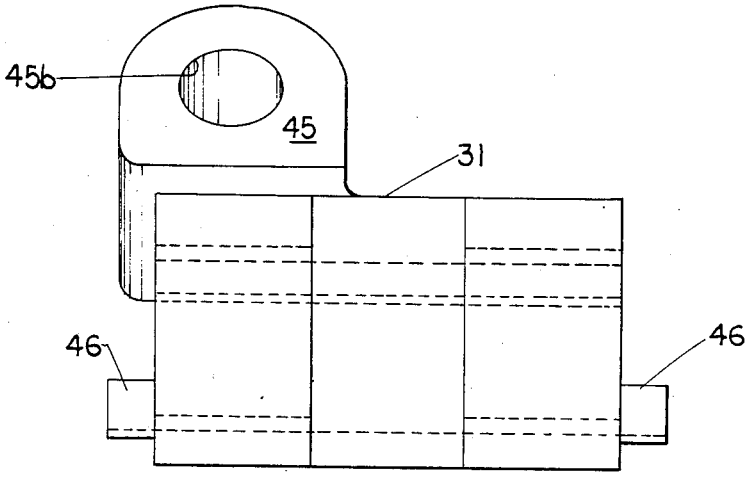
FIG. 8 is an end view taken from the right side of the link element of FIG. 7.

Considering now FIG. 6, along with FIGS. 7, 8 and 16, it will be observed that the link elements 31 are much like those discussed in connection with FIGS. 4 and 5 but they differ therefrom in having an added feature built into them. At either side of the middle portion of the H-shaped link element 31 there has been formed a load bearing lug 46. A number of H-shaped link elements 31 having these load bearing lugs 46 thereon are depicted in the middle sections of FIGS. 1 and 3. In the usual make up of a chain, however, most of the H-shaped link elements would be alike, that is, either most would have the lugs 46 thereon, or most would not. In those chains wherein the load bearing lugs 46 are utilized it will be observed that these give intermediate support between the connecting pins and they are perhaps of more importance on those outside links in chains which are supported at their sides as well as centrally thereof. As earlier mentioned the preferred H-shaped link elements (and chains made therefrom) will have the load carrying lugs 46 thereon and this will usually be true for most of the link elements in any given chain. It may be necessary, however, as also earlier indicated, to omit, or machine off, certain of the lugs 46 in those situations wherein they would otherwise interfere with the type of drive selected for a particular chain.

It has been mentioned that the bit carrying lug 45 could be affixed to the link element 31 on the surfaces 42 and 43 as by welding or the like. This, of course, is also the case with the surfaces 51 and 52 of the link element of FIG. 16. It should also be observed, however, that it is possible to forge the element 31 and lug 45 as an integral part. This is also true of the lug and link element of FIG. 16 wherein a modified lug **45*a* having its own abutment surface or anvil 44*a* is welded onto the link element 31. This anvil is for abutment by a rotatable bit. The link element 31 of FIG. 16 could have a lug 45 welded to the surface 51 in such manner that the surface 53 would serve as the anvil 44 or 44*a***.

Figure 6:
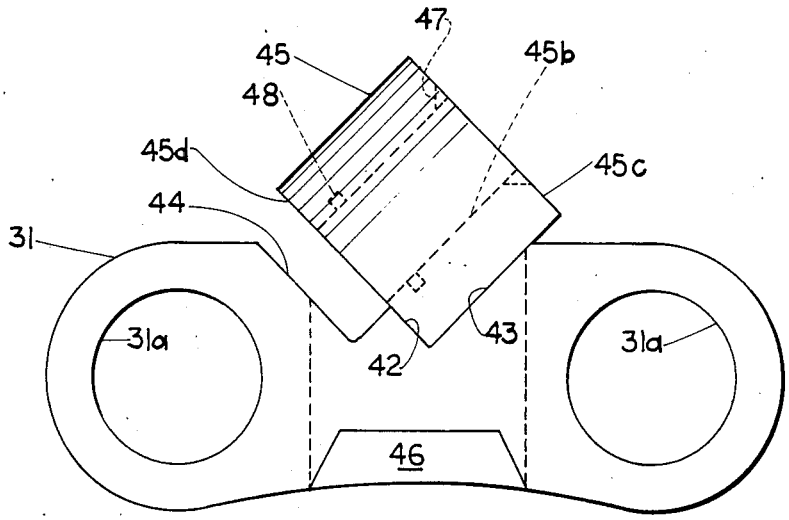
FIG. 6 is a view similar to FIG. 4 but illustrating a somewhat different H-shaped link element and also illustrating the use of a bit carrying lug mounted thereon.

It should also be understood that the bit carrying lug 45 may have other bits used therewith, such as, for example, a plumb-bob bit placed therein and to this end it could be formed with a depth determining abutment shoulder (bevel) 47 (FIG. 6). And, whether the bit employed be a plumb-bob bit, or a rotatable point attack bit which would abut the anvil surface 44 or **44*a* or 53, some sort of retaining means would be needed. This could be the internal means generally indicated at 48 or it could be external means on the bit between the lug face 45*d* and anvil as taught in U.S. Pat. No. 3,397,012. The means to maintain the bit within the bit receiving perforation 45*b* of the bit receiving lug 45 may take other forms. The bevel 47 and means 48 could be omitted and, for example, a bit having a flange to engage the face 45*c* of the lug 45 could be provided with a shank to extend beyond the face 45*d*** and have an external retainer thereon.

Figure 9:
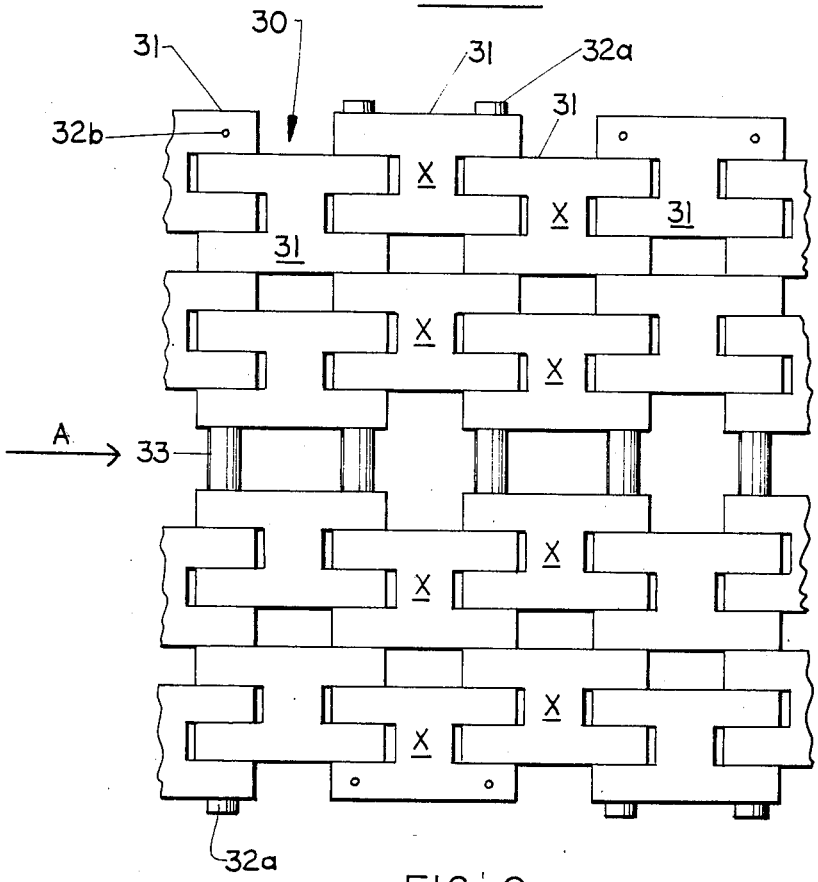
FIG. 9 is a fragmentary plan view of a section of chain constructed in accordance with this invention.

FIG. 9 depicts a portion of the chain section of FIG. 1 in which certain of the H-shaped link elements 31 have been marked with an X. As is also taught in U.S. Pat. No. 3,888,133 earlier referred to, chains of the type to which the present invention is directed, particularly when applied to mining machines and the like, are subject to considerable stress and wear. One of the ways in which the chain wear manifests itself is in an elongation of the chain. This is due primarily to an enlargement of the coaxial perforations **31*a* in the chain link ends and wear on the connecting pins 32. It is known in the art to provide the mining machine with take-up means to accommodate for such lengthening of the chain. However, when the maximum take-up adjustment of the mining machine has been employed, there generally has not been a sufficient elongation of the chain to permit simple removal from the chain of an adjacent pair of rows of link elements 31 such as have been marked with the letter X. The '133 patent solved this problem by substituting a Z-shaped link element for certain of the original link elements. The present invention contemplates two different ways of shortening a chain by removing therefrom two rows of adjacent link elements such as those marked with the letter X and substituting therefore other link elements. These are illustrated in FIGS. 10 and 11**.

Figure 10:
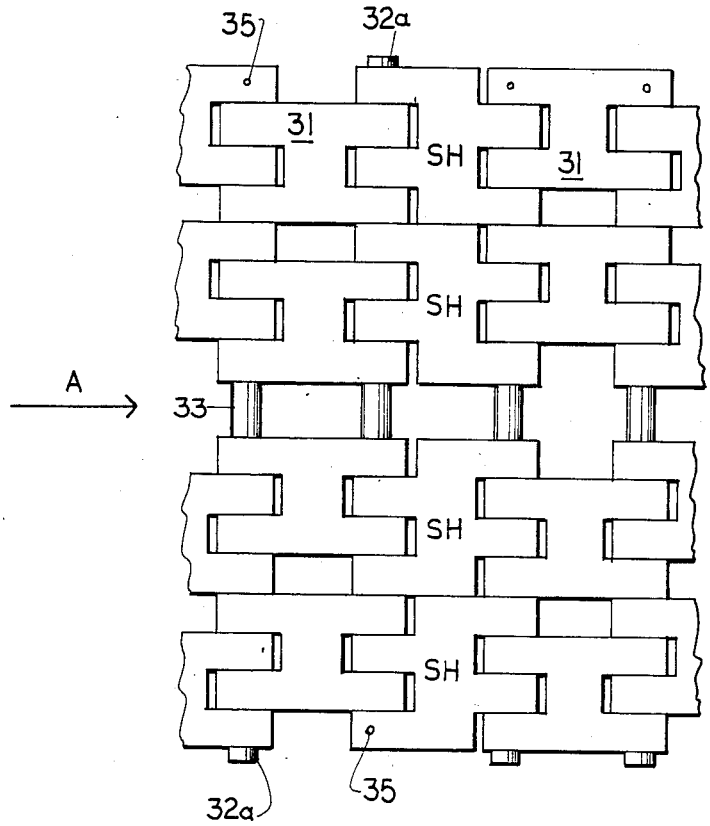
FIG. 10 illustrates how the chain of FIG. 9 may be shortened by removing two adjacent groups of interdigitated H-shape elements and replacing them with a single group of off-set H-shaped link elements.
Figure 11A:
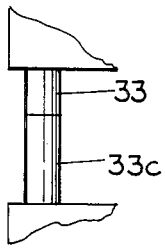
FIG. 11A is a diagrammatic depiction of an alternative arrangement for certain of the spacer elements employed in the chain of this invention.
Figure 13:
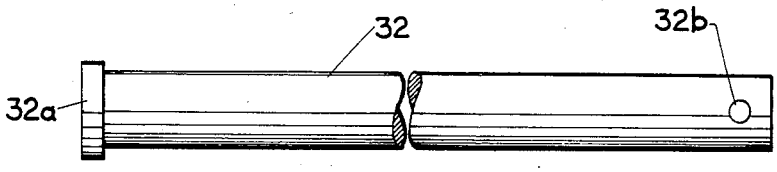
FIG. 13 depicts a connecting pin which may be used to connect adjacent rows of interdigitated link elements.
Figure 14:
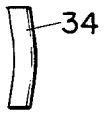
FIG. 14 depicts a retaining may be used with the connecting of FIG. 13.
Figure 15:
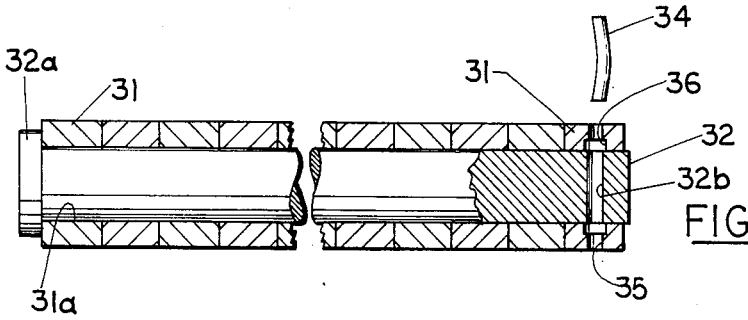
FIG. 15 is a fragmented view, partly in section, illustrating the manner in which the connecting pin, retaining pin and a plurality of H-shaped link elements may be arranged.

In FIG. 10 a link element designated as SH (an off-set H-shaped link element) has been substituted for a pair of adjacent interdigitated H-shaped link elements 31 marked with the letter X. That is to say, a row of these link elements SH replaces two rows of the link elements 31. The shape of the link element SH, the legs of the H being offset by the width of a leg, permits the element SH to be interdigitated with adjacent H-shaped link elements 31 without necessitating the provision of additional spacers. In this connection it will be understood, of course, that the legs of the element SH are provided with appropriate perforations to receive the connecting pin 32 and retaining pin 34.

A second way of accommodating for wear and the consequent lengthening of the chain is to replace the double row of H-shaped link elements 31 marked X in FIG. 9 with a single row of Y-shaped link elements. Again it will be understood that the three legs defining the Y will be provided with appropriate perforations to receive the connecting pin 32 and retaining pin 34. In this arrangement, however, as distinguished from that of FIG. 10, additional spacer elements are required at various places in the chain. One of these is indicated in the central portion of FIG. 11 where, in addition to the standard spacer element 33, additional spacer elements **33*a* are required. The arrangement of FIG. 11 permits the standard spacer elements 33 to remain in alignment throughout the chain, and it is on these that the sprocket teeth engage to drive this particular form of chain. An alternative arrangement, however, in order to reduce the number of parts making up the chain, would be to locate the standard spacer element 33 in the position shown in FIG. 11A and to replace the pair of spacer elements 33*a* with a single spacer element 33*c*. This might not be quite so desirable, however, depending on just where the sprocket teeth would engage these spacer elements 33, 33*c*. A further alternative would be to use a single spacer (not shown) in place of either the spacers 33 and 33*a* of FIG. 11 or the spacers 33 and 33*c*** of FIG. 11A.

Figure 19:
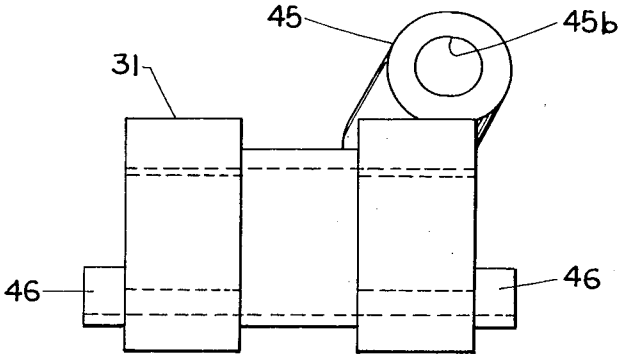
FIG. 19 is an end view taken from the right side of the link element of FIG. 17.
Figure 22:
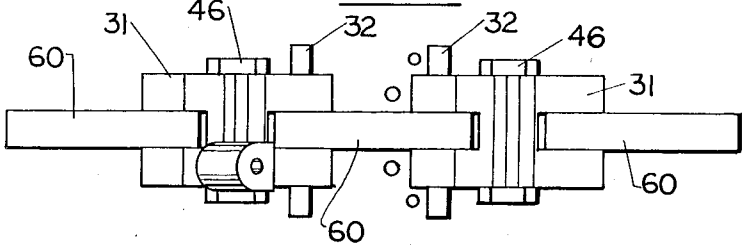
FIG. 22 is a schematic view depicting a chain comprised of non-interdigitated H-shaped elements arranged one to a "row".
Figure 17:
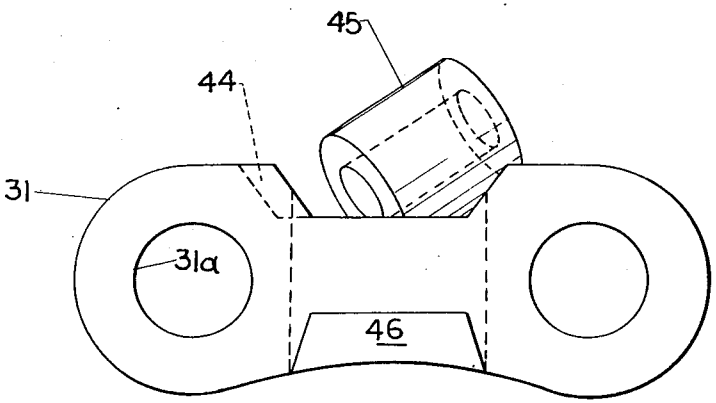
FIG. 17 is a side elevation of one of the H-shaped link elements of this invention and on which the bit carrying lug has been mounted at an angle (skewed)to the legs of the H.
Figure 18:
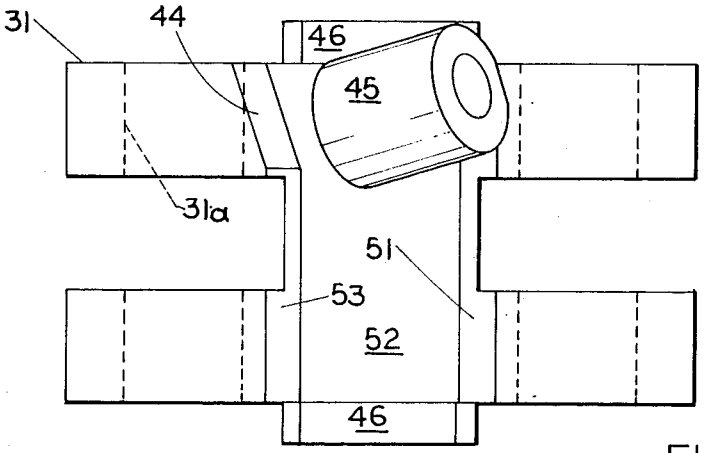
FIG. 18 is a plan view of the link element of FIG. 17.

Modifications may be made in this invention as will be understood by those skilled in the art. It is sometimes desirable, for example, to arrange the bit carrying lug 45 so that the bit is skewed with respect to the long axis of the chain. This is often desirable in order to increase the scope of material which may be reached and mined by the chain from a particular position. By way of examples only, such skewed lugs could be employed on outside link elements to further widen the cut, on interior link elements to eliminate kerfs or to provide clearance when needed, or to permit different bit spacings. This is depicted in FIGS. 17, 18 and 19 wherein like reference numerals have been employed to designate like parts, as has hereinbefore been the case throughout the description of the invention. In the manufacture of the H-shaped link element 31 designed to accommodate a skewed bit carrying lug 45, the slopes of the surfaces 42, 43 and 44 may be adjusted so that in those instances wherein the bit extends through the lug 45 and abuts the surface 44, such abutting faces of the bit and surface 44 will be in alignment. The element 31 may be forged to specifications to accommodate such arrangement or a standard H-shaped link element 31 could be machined to provide the appropriate bearing surfaces.

Other modifications are also possible. Thus, for example, a chain could be made up of link elements the majority of which are like the Y-shaped link element depicted in FIG. 11 and this is taught in a companion application filed of even date herewith.

Figure 21:
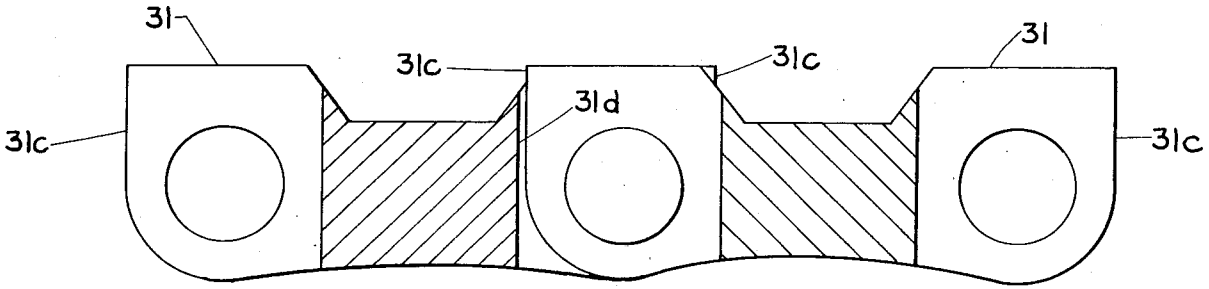
FIG. 21 is a section taken on the line 21—21 of FIG. 20.
Figure 20:
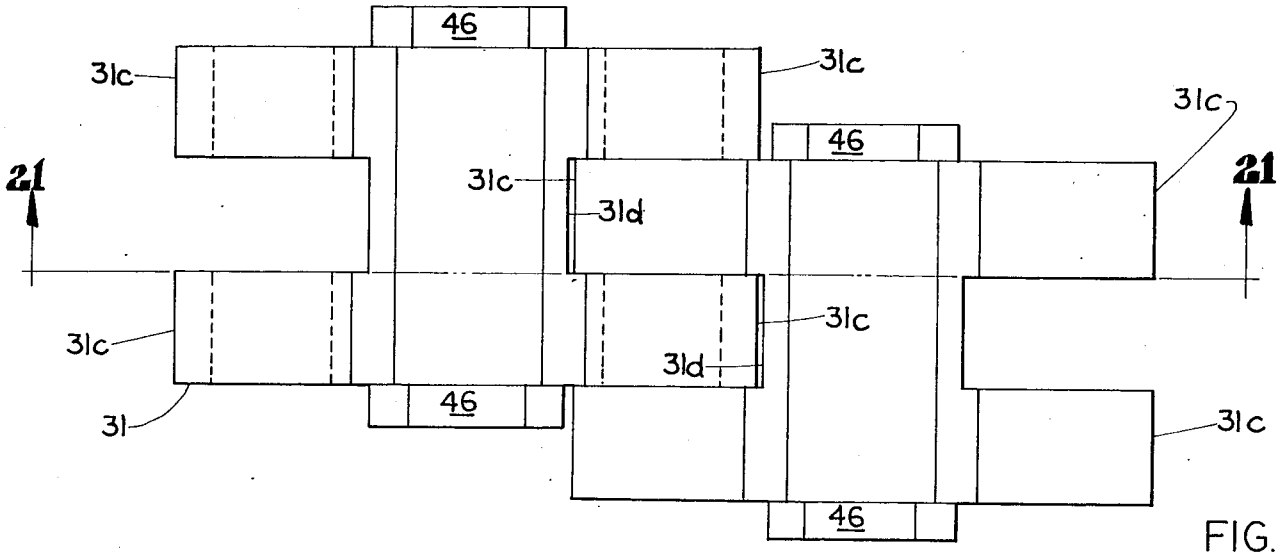
FIG. 20 is a plan view of part of a chain section comprised of a modified form of H-shaped link element.

Yet another modification would be to shape the H-shaped link elements 31 so as to aleviate what is known in the industry as "backlash", i.e., to prevent sagging of the chain during its driving between chain sprockets. One way of achieving this is illustrated in FIGS. 20 and 21. Referring first to FIG. 4, however, it will be noted that the ends of the legs of the H-shaped link elements are rounded or arcuate as indicated at **31*b*. In the arrangement of FIGS. 20 and 21 this rounded surface 31*b* has been replaced with a substantially straight surface 31*c*. As best seen in FIG. 21 this is done to both ends of each of the H-shaped link elements 31. Considering further the arrangements of FIGS. 20 and 21 it will be observed that should the righthand link element 31 as viewed in these figures tend to rotate about the center portion thereof in a counterclockwise direction, the lefthand surface 31*c* will abut the bridge section 31*d* of the H-shaped link element 31. By the same token, if the lefthand link element 31 tends to rotate in a clockwise direction that flat surface 31*c* which is interdigitated with the righthand link element 31 will abut the central portion 31*d* of that latter element. Thus it follows that sagging of the chain is substantially prevented. It should be further noted, however, that there is a clearance provided between the adjacent surfaces 31*c* and 31*d*** so as to permit the chain to move around its driving and idler sprockets. Some of these and related features are amplified in a companion application filed of even date herewith.

There are other modifications which may be desirable. Thus, by way of example only, it might be desirable to omit, or machine off, the load bearing lugs 46 in the chain of FIG. 1 wherein these lugs would otherwise appear between pairs of the spacer elements 33, depending somewhat on the relationship between the various elements and the sprocket teeth which drive the chain. A similar situation could arise in connection with the chain of FIG. 2 wherein it is possible that those load carrying lugs 46 which are positioned between the pins 32, that for example, at the upper side of the chain between pins 32 and **32*d* and that lug 46 at the lower side of the chain between the pin 32*d* and pin 32, may also interfere with proper driving of the chain. It is desirable to retain these lugs 46** where possible, however, for they do give increased support for the chain.

It will be apparent to those skilled in the art that even further modifications may be made in this invention without departing from the scope and spirit thereof. Thus, in FIG. 22, a chain may be made up of H-shaped link elements 31 according to this invention in which there is only one link element per lateral "row". The link elements of adjacent "rows" do not interdigitate with one another; rather, adjacent "rows" of link elements are joined by straps 60. Again, chain drive may be achieved by sprocket teeth engaging the end of the H-shaped link elements 31 in the areas marked by the letter O or by engagement with the ends of the connecting pins 32.

Figure 23:
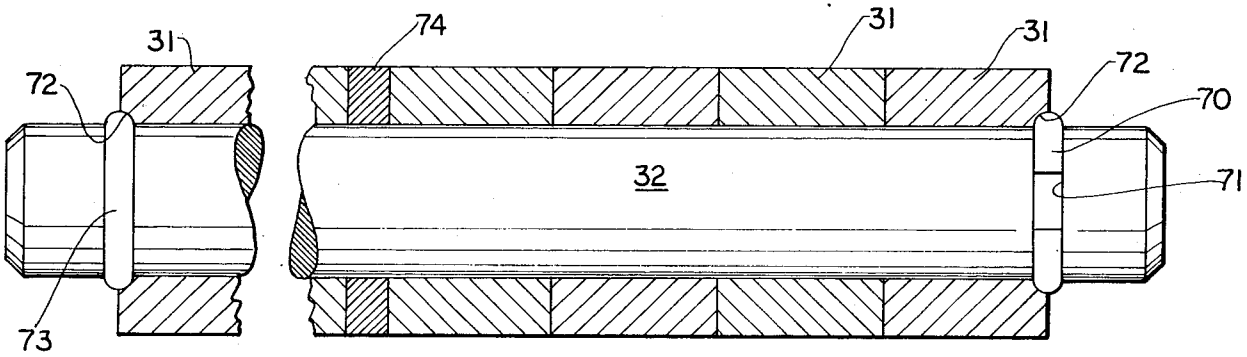
FIG. 23 is a fragmented view, partly in section, illustrating a modification of the means for retaining the connecting pin or pintle in an assembly of link elements.
Figure 24:
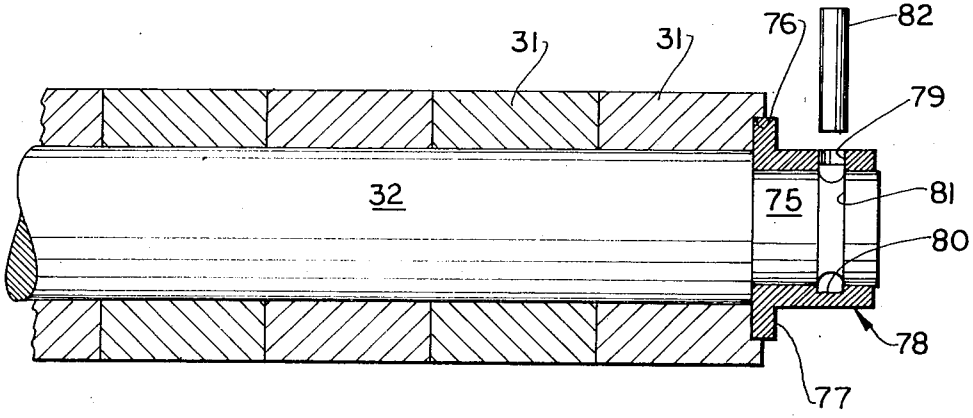
FIG. 24 is a fragmented view, partly in section, illustrating a further modification of the means for retaining the connecting pin or pintle in an assembly of link elements.

As earlier mentioned herein, see for example the discussion of FIGS. 1, 2 and 3 respecting the connecting pin or pintle 32, various arrangements may be utilized to secure the pin or pintle in an assembly of link elements. Additional modifications are illustrated in FIGS. 23 and 24. In the arrangement of FIG. 23 a plurality of interdigitated H-shaped link elements 31 is retained by means of a pair of abutments provided adjacent the outermost link elements at each end of a row thereof. As depicted at the righthand side of FIG. 23 one of the abutments may be comprised of a split ring 70 located in a groove 71 provided adjacent the end of the pintle 32. Preferably this split ring 70 is also at least in part received within an annular undercut 72 provided at the outermost edge of the outermost link element at that end of the row. The split ring 70 will have sufficient resiliency to enable it to be located within the groove 71.

That end of the connecting pin 32 which is seen at the lefthand side of the arrangement of FIG. 23 may be arranged like the righthand side just described, or the abutment may be comprised of a permanent protuberence 73. Preferably the outer side of the link disposed at the lefthand side of the assembly of link elements will also be provided with an annular undercut 72 to receive the abutment 73. In order to accomplish this arrangement a spacer 74 is provided between adjacent pairs of interdigitated H-shaped link elements. This spacer 74 is forced into position after the connecting pin or pintle 32 has been located within the assembled link elements 31 so as to spread apart the adjacent interdigitated link elements whereby to force the retainer 70 and abutment 73 into engagement within their respective undercut portions 72. If it becomes necessary to remove the connecting pin for any reason, this is accomplished by first removing the spacer 74 whereafter the endmost link elements 31 may be disengaged from the retainer element 70 and abutment 73.

In FIG. 24 a somewhat different arrangement is provided. As seen at the righthand side of that FIG., the end of the connecting pin or pintle 32 is preferably provided with a turned-down extension 75. The outer side of the endmost link at that end of the FIG. is provided with an undercut portion 76 to receive the flange 77 of a hat-shaped retainer element 78 which slides over the extension 75. This hat-shaped element 78 is provided with an opening 79 which terminates within an annular groove 80 provided therein. The pin extension 75 is provided with a corresponding annular groove 81. In order to retain the hat-shaped element 78 on the pin extension 75 a retaining pin 82 is driven through the hole 79 into the cooperating annular grooves 80 and 81 in the element 78 and extension 75 respectively. It would also be possible to replace the grooves 80 and 81 with another hole (not shown) in the extension 75, aligned with the hole 79, and to drive the pin 82 into both holes.

It will be understood by those skilled in the art that the lefthand side of the arrangement of FIG. 24 could be like that shown at the lefthand side of FIG. 23, for example, or it could also be a repeat of what is shown at the righthand side of FIG. 24. A spacer 74 may also be utilized in the manner of FIG. 23 depending on the precise nature of the retaining element selected for the lefthand side of the FIG. 24 arrangement.

The invention has been shown and described in terms of certain particular arrangements, patterns and structures, but the invention is not to be limited to those particular arrangements, patterns and structures except insofar as they are specifically set forth in the subjoined claims. And, as mentioned with respect to varying the length of the chains of this invention, so also may the width of such chanis be varied. This may be accomplished by adding H-shaped link elements, and perhaps spacers as well, to either side (the top and bottom, e.g., as viewed in FIGS. 1, 2 and 3) of the chains so as to achieve a chain of any desired width as circumstances may require. In some instances it may be necessary to eliminate certain at least of the load bearing lugs 46 and to provide longer pintles 32.

What is claimed is:

1. In a continuous chain for a mining machine or the like comprising a plurality of link elements arranged in rows extending across the width of the chain, at least some of said link elements constituting bit carrying link elements, the ends of said link elements having perforations therein for receiving a connecting pin, adjacent rows of said link elements being interdigitated so that the perforations in said interdigitated link elements are in alignment, a connecting pin received in said aligned perforations, and means to retain said connecting pin in said aligned perforations; the improvement which comprises: said link elements being H-shaped when viewed in plan, each said H-shaped link element having a central bridge portion and a pair of spaced parallel legs extending from either side thereof at right angles thereto, all of said legs being parallel to the direction of chain movement.

2. The chain of claim 1 in which each of said rows is comprised of a plurality of H-shaped link elements.

3. The chain of claim 2 in which at least some of said H-shaped link elements are positioned so as to be engagable by the teeth of a chain sprocket.

4. The chain of claim 1 in which each of said rows is comprised of four H-shaped link elements, and said chain including a row of aligned spacer elements located on said connecting pins centrally of said chain so as to separate each of said rows into two groups of two H-shaped link elements, groups of H-shaped link elements in adjacent rows being interdigitated, whereby said spacer elements may be engaged by the teeth of a chain sprocket located centrally of said chain.

5. The chain of claim 4 in which at least some of said H-shaped link elements are positioned so as to be engagable by the teeth of a chain sprocket.

6. The chain of claim 1 in which each of said rows is comprised of two H-shaped link elements, and said connecting pins having end portions which extend beyond the sides of said chain, whereby said end portions may be engaged by the teeth of chain sprockets located at the sides of said chain.

7. The chain of claim 6 in which at least some of said H-shaped link elements are positioned so as to be engagable by the teeth of a chain sprocket.

8. The chain of claim 1 in which each of said rows is comprised of four H-shaped link elements, and said chain including two rows of aligned spacer elements on said connecting pins arranged so as to separate the endmost H-shaped link element at each end of each row of link elements from the center pair of H-shaped link elements of each row of link elements, whereby each of said two rows of aligned spacers may be engaged by the teeth of chain sprockets located inwardly from the sides of said chain.

9. The chain of claim 8 in which at least some of said H-shaped link elements are positioned so as to be engagable by the teeth of a chain sprocket.

10. The chain of claim 1 in which each of said H-shaped bit carrying link elements is provided with a bit carrying lug having a perforation therein to receive a bit.

11. The chain of claim 10 in which said lug is fixed on said central bridge portion.

12. The chain of claim 11 in which said central bridge portion is provided with an abutment surface against which a bit may abut.

13. The chain of claim 10 in which said bit carrying lug includes a bit abutment surface.

14. The chain of claim 10 in which said lug perforation is in line with said direction of chain movement.

15. The chain of claim 10 in which said lug perforation is skewed with respect to said direction of chain movement.

16. The chain of claim 10 in which at least some of said H-shaped link elements are positioned so as to be engagable by the teeth of a chain sprocket.

17. The chain of claim 1 in which said central bridge portion is comprised of a plurality of surfaces which impart a W-shape to said H-shaped bit carrying link when viewed in side elevation.

18. The chain of claim 17 including a bit carrying lug mounted on two of said surfaces, a third one of said surfaces constituting an abutment surface against which a bit may abut.

19. The chain of claim 17 in which at least some of said H-shaped link elements are positioned so as to be engagable by the teeth of a chain sprocket.

20. The chain of claim 1 including a load bearing lug adjacent a side of said central bridge portion and extending outwardly therefrom.

21. The chain of claim 20 including a said load bearing lug on both sides of said central bridge portion.

22. The chain of claim 20 in which at least some of said H-shaped link elements are positioned so as to be engagable by the teeth of a chain sprocket.

23. The chain of claim 1 in which the means to retain said connecting pin in said aligned perforations includes a retaining pin, a hole in said connecting pin to receive said retaining pin, said retaining pin being longer than the diameter of said connecting pin, a hole in a said link element through which said retaining pin may pass, and an annular channel in said link element in the region of said last mentioned hole, said retaining pin being shorter than the diameter of said channel whereby said retaining pin may rotate within said channel.

24. The chain of claim 1 in which the ends of said legs are arcuate, the sides of said central bridge portion between said spaced parallel legs being substantially vertical when the H-shaped link element is viewed in side elevation.

25. The chain of claim 1 in which the ends of said legs and the sides of said central bridge portion between said spaced parallel legs are all substantially vertical when the H-shaped link element is viewed in side elevation, whereby the tendency of said chain to sag is resisted by engagement of a vertical, interdigitated leg end with a vertical bridge side so that backlash is alleviated.

26. The chain of claim 1 in which two adjacent rows of said H-shaped link elements are removed and replaced by a single row of off-set H-shaped link elements, each of said off-set elements having a modified central bridge portion, said pair of spaced parallel legs at either side of said modified bridge portion being off-set with respect to one another by an amount equal to the width of a said leg, whereby to shorten the chain while preserving the interdigitated continuity of the chain.

27. The chain of claim 1 in which two adjacent rows of said H-shaped link elements are removed and replaced by a single row of Y-shaped link elements and by added spacer elements, whereby to shorten the chain while preserving the interdigitated continuity of the chain.

28. The chain of claim 1 in which said central bridge portion is comprised of a plurality of surfaces which define an area in which a bit carrying lug may be situated, said surfaces being comprised of a horizontal surface and a first sloping surface, said first sloping surface extending downwardly from one of said pair of spaced parallel legs towards said horizontal surface.

29. The chain of claim 28 including a bit carrying lug mounted on said first sloping, surface.

30. The chain of claim 29 including a second sloping surface constituting an abutment surface against which a bit may abut, said second sloping surface extending downwardly from the other of said pair of spaced parallel legs toward said horizontal surface.

31. The chain of claim 30 in which said bit carrying lug includes an integral bit abutment surface, said bit carrying lug also engaging said horizontal surface and said second sloping surface, said integral bit abutment surface overlying said second sloping surface.

32. The chain of claim 20 in which at least some of said H-shaped link elements are positioned so as to be engagable by the teeth of a chain sprocket.

33. The chain of claim 1 in which at least some of said H-shaped link elements are positioned so as to be engagable by the teeth of a chain sprocket.

34. The chain of claim 1 in which the said means to retain said connecting pin in said aligned perforations includes an abutment on one end of said connecting pin to abut the outer side of a link element at one end of a row and a hole in and adjacent the other end of said connecting pin, a corresponding hole on that link element which is at the other end of said row, and a retaining pin having an interference fit within both of said holes.

35. The chain of claim 1 in which the said means to retain said connecting pin in said aligned perforations includes a pair of holes in said connecting pin, one hole adjacent each end of said connecting pin, each of the outermost link elements at each end of a row of said link elements having a hole therein aligned with one of the holes in said connecting pin, and a pair of retaining pins, each retaining pin having an interference fit with a pair of said aligned holes.

36. The chain of claim 1 in which the said means to retain said connecting pin in said aligned perforations includes an annular groove in and adjacent a first end of said connecting pin, an abutment means at the second end of said connecting pin to engage an adjacent endmost link element of a row of link elements, and a split ring within said groove, said split ring abutting the endmost link element at the adjacent end of said row of link elements.

37. The chain of claim 36 in which said last mentioned link element is provided with an annular undercut to receive said split ring.

38. The chain of claim 37 including a spacer on said connecting pin located between pairs of interdigitated link elements whereby to force said split ring into said annular undercut 39. The chain of claim 1 in which the said means to retain said connecting pin in said aligned perforations includes an abutment means at one end of said connecting pin to engage an endmost link element at one end of a row of link elements, a hat-shaped member disposed on the other end of said connecting pin, a first hole in said hat-shaped member, a second hole in said connecting pin, said first and said second holes being aligned, and a retaining pin secured in said aligned holes, said hat-shaped member abutting the endmost link element at the other end of said row of link elements.

40. The chain of claim 39 in which said last mentioned link element is provided with a recess to receive a part at least of said hat-shaped member.

41. The chain of claim 39 in which said hat-shaped member has a bore to enable it to be slipped on said other end of said connecting pin, said hat-shaped member having an arcuate groove therein within said bore and communicating with said first hole, and said second hole comprising an arcuate groove on said other end of said connecting pin, said retaining pin being disposed in said arcuate grooves.

42. The chain of claim 1 in which the said means to retain said connecting pin in said aligned perforations includes an abutment means fixed at each end of said connecting pin, each of said abutment means engaging that endmost link element, of a row of link elements disposed on said connecting pin, which is adjacent thereto, the outer side of at least one of said endmost link elements being adapted to receive a portion at least of that abutment means which engages it.

43. A chain link element which is H-shaped when viewed in plan, said H-shaped link element being for use in making up chains for mining machines and the like, said link elements comprising a central bridge portion, a first pair of spaced parallel legs extending from one sie of said bridge portion perpendicular thereto, a second pair of spaced parallel legs extending from the other side of said bridge portion perpendicular thereto, all of said legs of said first and second pairs being parallel to the direction of intended chain movement, each of said first and second pairs of legs being provided with aligned pintle receiving perforations, said central bridge portion not extending above said legs when said link element is viewed in side elevation.

44. An H-shaped link element according to claim 43 in which said link element is provided with a bit carrying lug having a perforation therein to receive a bit.

45. A link element according to claim 44 in which said bit carrying lug includes a bit abutment surface.

46. A link element according to claim 44 in which said lug perforation is in line with said direction of intended chain movement.

47. A link element according to claim 44 in which said lug perforation is skewed with respect to said direction of intended chain movement.

48. A link element according to claim 43 including a load bearing lug adjacent a side of said link element adjacent an end of said central bridge portion and extending outwardly therefrom.

49. The link element of claim 48 including a said load bearing lug on both sides of said link element adjacent each end of said central bridge portion and extending outwardly therefrom.

50. A link element according to claim 43 in which the ends of said legs are arcuate, the sides of said central bridge portion between said spaced parallel legs being substantially vertical when the H-shaped link element is viewed in side elevation.

51. Anti-backlash means for trim and cutting chains used in the mining and construction industries, each chain being of the type comprising a plurality of H-shaped links each of which has a central bridge portion with forward and rearward edges, each central bridge portion having a pair of spaced parallel legs directed forwardly from its forward edge and a pair of spaced parallel legs directed rearwardly from its rearward edge, said forward and rearward legs having transverse perforations therein, said chain being arranged in lateral rows each of which is at least one link wide, said links being arranged one behind the other in at least one longitudinal column and with the said forward and rearward legs of successive rows being interdigitated and the said transverse perforations of the interdigitated legs being coaxial, connecting pins extending through said coaxial perforations to form an endless chain, each of said forward and rearward legs being provided with an abutment surface, each of said forward and rearward edges being provided with a further abutment surface between said legs thereon, the abutment surface of one of the forward legs of one central bridge portion cooperating with the said further abutmetn surface on the rearward edge of an adjacent central bridge portion in said column, and the abutment surface of one of the rearward legs of said one central bridge portion cooperating with the said further abutment surface on the forward edge of an adjacent central bridge portion in said column, whereby to limit and substantially minimize backlash and chain sag.

52. A chain link element which is H-shaped when viewed in plan, said H-shaped link element being for use in making up chains for mining machines and the like, said link element comprising a central bridge portion, a first pair of spaced parallel legs extending from one side of said bridge portion perpendicular thereto, a second pair of spaced parallel legs extending from the other side of said bridge portion perpendicular thereto, all of said legs of said first and second pairs being parallel to the direction of intended chain movement, each of said first and second pairs of legs being provided with aligned pintle receiving perforations, said link element being provided with a bit carrying lug having a perforation therein to receive a bit, said lug being fixed on said central bridge portion.

53. The link element of claim 52 in which said central bridge portion is provided with an abutment surface against which a bit may abut.

54. A chain link element which is H-shaped when viewed in plan, said H-shaped link element being for use in making up chains for mining machines and the like, said link element comprising a central bridge portion, a first pair of spaced parallel legs extending from one side of said bridge portion perpendicular thereto, a second pair of spaced parallel legs extending from the other side of said bridge portion perpendicular thereto, all of said legs of said first and said second pairs being parallel to the direction of intended chain movement, each of said first and said second pairs of legs being provided with aligned pintle receiving perforations, said central bridge portion comprising a plurality of surfaces which impart a W-shape to said H-shaped link element when viewed in side elevation.

55. The link element of claim 54 including a bit carrying lug mounted on two of said surfaces, a third one of said surfaces constituting an abutment surface against which a bit may abut.

56. A chain link element which is H-shaped when viewed in plan, said H-shaped link element being for use in making up chains for mining machines and the like, said link elements comprising a central bridge portion, a first pair of spaced parallel legs extending from one side of said bridge portion perpendicular thereto, a second pair of spaced parallel legs extending from the other side of said bridge portion perpendicular thereto, all of said legs of said first and second pairs being parallel to the direction of intended chain movement, each of said first and second pairs of legs being provided with aligned pintle receiving performations, the ends of said legs and the sides of said central bridge portion between said spaced parallel legs are all substantially vertical when the H-shaped link element is viewed in side elevation.

57. A chain link element which is H-shaped when viewed in plan, said H-shaped link element being for use in making up chains for mining machines and the like, said link element comprising a central bridge portion, a first pair of spaced parallel legs extending from one side of said bridge portion perpendicular thereto, a second pair of spaced parallel extending from the other side of said bridge portion perpendicular thereto, all of said legs of said first and said second pairs being parallel to the direction of intended chain movement, each of said first and second pairs of legs being provided with aligned pintle receiving perforations, said central bridge portion comprising a plurality of surfaces which define an area in which a bit carrying lug may be situated, said surfaces being comprised of a horizontal surface and a first sloping surface, said first sloping surface extending downwardly from one of said pair of spaced parallel legs toward said horizontal surface.

58. The H-shaped link element of claim 57 including a second sloping surface, said lug second sloping surface extending downwardly from the other of said pair of spaced parallel legs towards said horizontal surface.

59. The H-shaped link element of claim 58 including a bit carrying lug affixed to said first sloping surface, said bit carrying lug having a perforation therein to receive a bit, said perforation extending towards said second sloping surface.

60. The H-shaped link element of claim 57 including a bit carrying lug affixed to said first sloping surface, said bit carrying lug having a perforation therein to receive a bit.

61. The H-shaped link element of claim 60 in which said perforation is in line with said direction of intended chain movement.

62. The H-shaped link element of claim 60 in which said lug perforation is skewed with respect to said direction of intended chain movement.

63. The H-shaped link element of claim 54 including a first load bearing lug adjacent a side of said link element adjacent an end of said central bridge portion.

64. The H-shaped link element of claim 63 including a second load bearing lug adjacent the side of said link element opposite said first mentioned side and adjacent the end of said central bridge portion opposite said first mentioned end.

65. The H-shaped link element of claim 64 including a second sloping surface, said second sloping surface extending downwardly from the other of said pair of spaced parallel legs towards said horizontal surface.

66. The H-shaped link element of claim 65 in which the ends of said legs are arcuate, the sides of said central bridge portion between said spaced parallel legs being substantially at right angles to said horizontal surface.

67. The H-shaped link element of claim 65 in which the ends of said legs and the sides of said central bridge portion between said spaced parallel legs are all substantially vertical when said H-shaped link element is viewed in side elevation.

68. A link element for a mining machine cutting chain, said link element being provided with a central bridge portion and a first pair of spaced parallel legs extending from one side of said central bridge portion at right angles thereto, and a second pair of spaced parallel legs extending from the other side of said central bridge portion at right angles thereto, all of said legs being provided with pintle receiving perforations, the perforations on any one side of said central bridge portion being in alignment, said first and second pairs of spaced parallel legs being off-set with respect to one another by the width of a said leg whereby said link element has an off-set H-shape when viewed in plan.

69. A chain for mining machines and the like, said chain comprising a succession of H-shaped link elements (H-shaped when viewed in plan) located in a single column, one behind the other, each said link element being provided with a central bridge portion and a pair of spaced parallel legs extending from either side thereof at right angles thereto, all of said legs being parallel to the direction of intended chain movement, each pair of spaced parallel legs being provided with aligned pintle receiving perforations, the corresponding legs of adjacent H-shaped link elements being in linear alignment, a strap element having a first end adapted to be received between the spaced parallel legs of one pair on one link element and a second end adapted to be received between the spaced parallel legs of one pair on an adjacent link element, said first and second ends each having a pintle receiving perforation therein, and a pintle extending through the aligned pintle receiving perforations of a pair of spaced parallel legs and through the pintle receiving perforation of the strap end engaged therebetween, and bit receiving lugs mounted on selected ones of said H-shaped link elements.

70. The chain of claim 69 including load carrying lugs adjacent the sides of selected ones of said link elements adjacent the ends of said central bridge portions and extending outwardly therefrom.

71. The chain of claim 69 in which at least some of said H-shaped link elements are positioned so as to be engagable by the teeth of a chain sprocket.

* * * * *